US007081714B2

(12) United States Patent
Galosky

(10) Patent No.: US 7,081,714 B2
(45) Date of Patent: Jul. 25, 2006

(54) INCANDESCENT LIGHT BULB LIFE EXTENDING APPARATUS

(76) Inventor: David Galosky, 8205 Hammond Branch Way, Laurel, MD (US) 20723

( * ) Notice: Subject to any disclaimer, the term of this patent is extended or adjusted under 35 U.S.C. 154(b) by 0 days.

(21) Appl. No.: 10/839,731

(22) Filed: May 4, 2004

(65) Prior Publication Data

US 2005/0248292 A1 Nov. 10, 2005

(51) Int. Cl.
*H05B 37/02* (2006.01)

(52) U.S. Cl. ..... 315/159; 315/158

(58) Field of Classification Search ..... 315/291, 315/224, DIG. 3, 149, 150, 151, 158, 159
See application file for complete search history.

(56) References Cited

U.S. PATENT DOCUMENTS 4,980,607 A 12/1990 Albert et al.
5,017,838 A 5/1991 Nilssen
5,519,263 A * 5/1996 Santana, Jr. ..... 307/115
5,789,869 A 8/1998 Lo et al.
5,965,985 A * 10/1999 Nerone ..... 315/225
6,114,813 A * 9/2000 Lo et al. ..... 315/159
6,201,351 B1 * 3/2001 Rudolph et al. ..... 315/159
6,294,874 B1 * 9/2001 Rudolph et al. ..... 315/158
6,294,901 B1 9/2001 Peron
6,300,725 B1 * 10/2001 Zinkler et al. ..... 315/291
6,448,713 B1 * 9/2002 Farkas et al. ..... 315/291
2002/0101193 A1 * 8/2002 Farkas et al. ..... 315/291

* cited by examiner

*Primary Examiner*—Tuyet Vo
*Assistant Examiner*—Minh Dieu A
(74) *Attorney, Agent, or Firm*—Ober / Kaler; c/o Royal W. Craig

(57) ABSTRACT

An incandescent light bulb life extending apparatus operates by modifying or wave shaping the A.C. power that supplies power to a lamp or light fixture, using a phase control circuit that is fixed at a specific phase that does not change. The light bulb life extending apparatus is housed in a plug in/plug into enclosure with prongs on one side that plug into a standard ordinary A.C. wall socket or receptacle, and a lamp power cord or similar light fixture power cord then plugs into the receptacle located on the opposing side of the enclosure.

11 Claims, 8 Drawing Sheets

*Inside Top View*

INCANDESCENT LIGHT BULB LIFE EXTENDING APPARATUS

CROSS-REFERENCE TO RELATED APPLICATIONS

The present application derives priority from U.S. Provisional Patent Application No. 60/464,679 filed Apr. 22, 2003.

BACKGROUND OF THE INVENTION

1. Field of the Invention

The present invention relates generally to extending the life of incandescent light bulbs and, more particularly, to an incandescent light bulb life extending apparatus fixed phase control circuit.

2. Description of the Background

For economy and convenience, many people prefer a light bulb that lasts longer than the standard light bulb.

Standard light bulbs burn out due to the high temperature of a tungsten filament. With standard incandescent light bulbs, the tungsten filament tends to evaporate unevenly. Thinner spots on the tungsten filament are more resistive than the average parts of the filament. With current equal on all parts of the filament, more heat is generated along the thinner spots of the filament. With the thinner spots hotter, these spots tend to evaporate more rapidly than the cooler spots of the filament. This phenomenon increases the speed of the tungsten evaporation along the thinner sports until the thin spot either melts or breaks.

Switching on the power to a standard incandescent light bulb creates another problem. A cold standard incandescent light bulb is less resistive than a hot one. As a result, a standard light bulb draws excessive current until the filament warms up.

Thus, a need exists to extend the life of a standard bulb exists in most homes and businesses. There have been a number of attempts to extend the life of light bulbs within the light bulb itself. Unfortunately, longer lasting light bulbs are expensive, and must be replaced with a longer lasting light bulb to implement an extended light bulb service. The expense of purchasing a longer life light bulb is a severe limitation.

Thus, there remains a need for a simple, comparatively inexpensive reliable means for extending the useful life of existing incandescent light bulbs. However, to be effective a light bulb life extending apparatus must be easy to install and must be cost effective. Moreover, a light bulb life extending apparatus should extend the life of a standard light bulb significantly, when used on a continuous basis. With the foregoing in mind, it would be greatly advantageous to provide a life-extending light bulb apparatus that overcomes these cost and housekeeping problems associated with previous longer light bulbs or systems, by operating with a standard incandescent light bulb.

A number of inventions alter the amount of light emanating from a light source. For example, U.S. Pat. No. 5,017,838 to Nilssen shows a frequency converter that converts 120 Volt/60 Hz received from a power line to an output of 120 Volt/30 kHz, thereby increasing the luminous efficacy. U.S. Pat. No. 6,294,901 to Peron and U.S. Pat. No. 5,789,869 to Lo et al. each show dimmer switch mechanisms.

U.S. Pat. No. 4,980,607 to Albert et al. issued Dec. 25, 1990 shows a light bulb life extender made in a small disc-like form and designed to be removably insertable into a light bulb socket. The device employs a silicon bilateral voltage triggered switch specifically designed to allow a voltage output of a predetermined percentage of the voltage input. Through this reduction in voltage, the associated light bulb will burn slightly less brightly but with significantly extended life span.

While each of the foregoing examples alter the amount of light emanating from a light source either by changing the frequency or by limiting current, none contemplate the use of a phase control circuit. It would be far more advantageous to approach the problem by modifying the A.C. power to the lamp or light fixture using a fixed phase control circuit. This approach would allow the life extending standard light bulb apparatus to accomplish its task without adding complexity to the bulb itself, thereby providing an alternative to expensive longer lasting light bulbs. The inexpensive standard incandescent light bulb would have a significantly extended life, and even then could be replaced with another inexpensive standard incandescent light bulb so that it too could have a significantly extended life without the added cost of purchasing an expensive longer life bulb.

SUMMARY OF THE INVENTION

It is the object of the present invention to provide a standard incandescent light bulb life extending apparatus that significantly extends the life of a standard incandescent light bulb with reliability.

It is another object of the present invention to provide a standard incandescent light bulb life extending apparatus that is simple in operation.

It is yet another object of the present invention to provide a standard incandescent light bulb life extending apparatus that is simple and easy to maintain.

It is still another object of the present invention to provide a standard incandescent light bulb life extending apparatus that plugs into a standard power outlet.

It is another object of the present invention to provide a standard incandescent light bulb life extending apparatus into which a lamp or light fixture's power cord can be safely plugged.

It is another object of the present invention to provide a standard incandescent light bulb life extending apparatus that is utilized in connection with homes, businesses, and all environments that use standard incandescent light bulbs.

It is another object of the present invention to provide a fixed phase control electronic means residing in a suitable enclosure to modify or wave shape the A.C. power signal in order to extend the life of an incandescent light bulb.

It is yet another object of the present invention to minimize the radio frequency voltage that is conducted back onto the A.C. power line.

These and other objects are accomplished by an incandescent light bulb life extending apparatus that operates by modifying or wave shaping the A.C. power that supplies power to a lamp or light fixture, using a phase control circuit that is fixed at a specific phase that does not change.

The incandescent light bulb life extending apparatus generally comprises a fixed phase control circuit for connection between standard 120V AC power source and an existing incandescent lighting circuit. The fixed phase control circuit includes a low pass filter coupled to a 120V AC power source, a triac coupled to an existing lighting circuit, and a diac coupled between the low pass filter and triac for gating the triac. The fixed phase control circuit operates to wave shape the A.C. power from the source as applied to the lighting circuit at a specific phase that does not change. The triac and diac combination may be replaced by a single quadrac. In addition, the light bulb life extending apparatus can be housed in a plug in/plug into enclosure with prongs on one side that plug into a standard ordinary A.C. wall socket or receptacle, and a lamp power cord or similar light fixture power cord then plugs into the receptacle located on the opposing side of the enclosure.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1A:
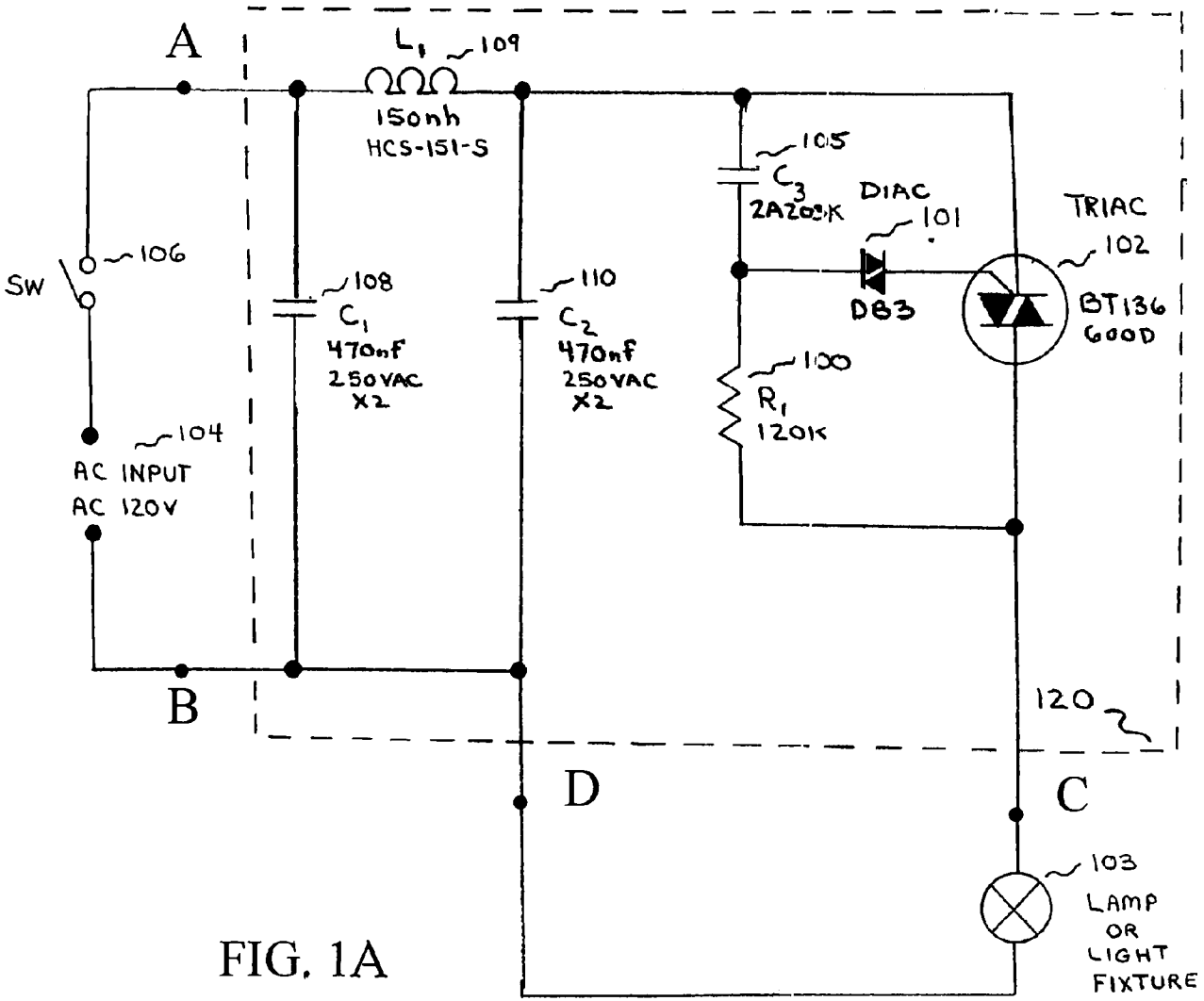
FIG. 1A illustrates a schematic diagram of the incandescent light bulb life extending apparatus fixed phase control circuit 120 according to one embodiment of the present invention.

FIG. 1A illustrates a schematic diagram of the incandescent light bulb life extending apparatus fixed phase control circuit 120 according to one embodiment of the present invention. The fixed phase control circuit 120 has first and second connection terminals A & B for connection to an AC power source. The lamp or light fixture 103 also has third and fourth terminals C & D for connection to an existing incandescent lamp or light fixture 103. The first terminal A and second terminal B of the fixed phase control circuit 120 are connected in parallel across a standard 120 V.A.C. 60 Hz power source 104 in series with a switch 106. The third and fourth terminals C & D of the fixed phase control circuit 120 are parallel-connected to the conventional lamp or light fixture 103. In practice, the fixed phase control circuit 120 may be housed in an enclosure (dotted lines), terminals A & B are connected to a switched wall outlet by insertion of a two-prong plug, and the plug of light fixture 103 is connected to terminals C & D by insertion into a receptacle mounted on the enclosure. The A.C. input 104 supplies 120 V.A.C. to and through the incandescent light bulb life extending apparatus fixed phase control circuit 120 to light fixture 103.

The fixed phase control circuit 120 comprises a first capacitor 108 and a second identical capacitor 110 both having capacitance of approximately 470 nf. Capacitors 108 and 110 may be commercially-available part numbers PHE840 MB6470 MB16R17 obtainable from PIK Power, Inc. located at Nine Austin Drive, P.O. Box 147, Marlborough, Conn. 06447. The first capacitor 108 is parallel-connected across terminals A–B. In addition, an inductor 109 having inductance of approximately 150 nh is connected at one side to terminal A, and capacitor 110 is connected from the other side of inductor 109 to terminals B & D. The inductor 109 may be a commercially-available part number HCS-151-S obtainable from Wilco Corporation located at 6451 Seguaro Court, Indianapolis, Ind. 46268.

A third capacitor 105 having capacitance of approximately 0.02 uf is connected on one side to the junction of inductor 109 and capacitor C2, and on the other side in series with a resistor 100 and on to terminal C. Capacitor 105 may be commercially-available part number PF2A203K obtainable from Atex Electronics located at 10731 Gulfdale, San Antonio, Tex. 78216. The resistor 100 of approximately 120 K ohms may be part number 38C9510 obtainable from NewarkInOne located at 7272 Park Circle Drive, Suite 260, Hanover, Md. 21076-1306.

A diac 101 is connected on one side between the capacitor 105 and resistor 100, and on the other side to the gate of a triac 102. Diac 101 may be a commercially-available part number DB3 obtainable from Pioneer Standard, and triac 102 may be part number BT136-600D obtainable from Pioneer Standard located at 9100 Gaither Road, Gaithersburg, Md. 20877. The junction leads of Triac 102 are connected between the inductor 109 to terminal C as shown. Lastly, the switch 106 is electrically connected in series between the A.C. input 104 and terminal A.

In operation of the previously described arrangement set forth in FIG. 1A, when the A.C. power is applied across terminals A–B by closing switch 106, capacitor 108, inductor 109, and capacitor 110 reduce the radio frequency voltage conducted back onto the A.C. power line. The A.C. power is then presented to the capacitor 105 connected to resistor 100 passing the A.C. power signal to the diac 101. The diac 101 is triggered when the A.C. signal reaches the diac 101 firing point, thereby gating and switching on the triac 102. As the current through the triac 102 drops to zero, the capacitor 105, resistor 100, and diac 101 network delays the switching on of the triac 102 for subsequent zero current crossing. The delay angle or non-conducting angle is a function $\phi=\omega RC$. The switching on of the triac is synchronized with the zero crossing point of the current through the triac 102.

Given the above-described electrical connections and circuit operation of FIG. 1A, the operation of the fixed phase control circuit 120 in conjunction with the lamp or light fixture 103 will now be described. Basically, the circuit 120 functions as a fixed phase control circuit whereby the conduction angle associated with a power waveform of the A.C. power signal, provided via A.C. input 104, is fixed and does not change via the fixed phase control circuit 120 of the present invention. Particularly, the conduction angle is determined by the values capacitor 105, resistor 100, diac 101, and triac 102.

Figure 1B:
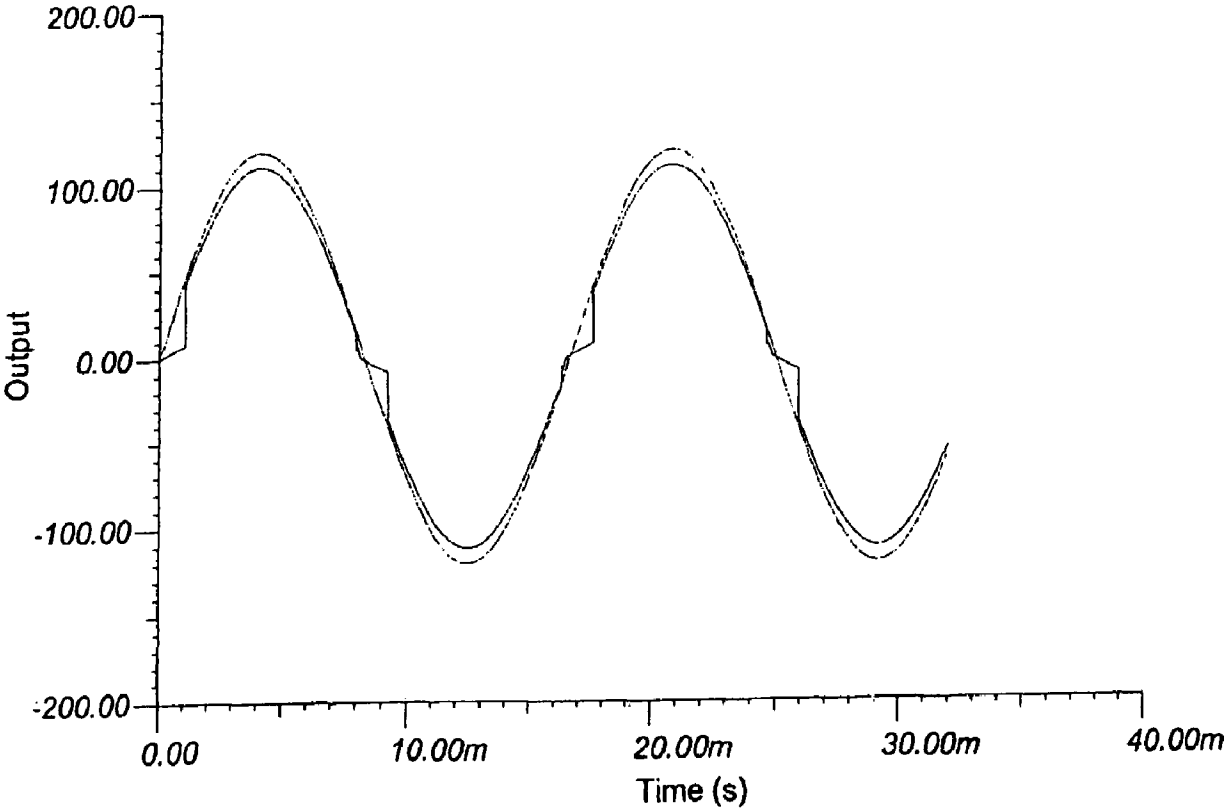
FIG. 1B is a composite graph of a 60 Hz A.C. power signal provided by the A.C. input 104 and the fixed phase control A.C. power signal presented to the lamp or light fixture 103, depicting the delay phase angle and conduction angle of the A.C. power line as a function of angular degrees, using the fixed phase control circuit 120 of FIG. 1A.

FIG. 1B illustrates a composite 60 Hz A.C. power signal provided by the A.C. input 104 and the fixed phase control A.C. power signal as presented to the lamp or light fixture 103. The simulated drawing depicts the delay phase angle and conduction angle of the A.C. power line as function of angular degrees. Accordingly, the specific manner in which the fixed phase control circuit functions will now be described. The incandescent light bulb is predominantly a resistive load Therefore, the line voltage and line current are in phase with each other. When the A.C. power 104 is applied (switch 106 is closed) and lamp 103 is in the circuit, the fixed phase control circuit begins the process of modifying the A.C. power signal. The capacitor 105 and resistor 100 form a triggering network. During the first ½ cycle of the power signal, the capacitor 105 connected to the resistor 100 passes the 120 VAC input signal to the diac 101. The capacitor 105 and resistor 100 form a lead phase shift circuit with respect to the input 120 VAC signal. The diac 101 characteristically has a break over or firing voltage which, when applied to the diac 101, begins operating in its negative resistance region. When the differential voltage of capacitor 105 (passing the A.C. line voltage providing a small phase lead shift) reaches the diac 101 firing voltage, the diac 101 begins operating in its negative resistance region. This trigger signal is applied to the gate of triac 102. Triac 102 is triggered into a conduction mode whereby A.C. current begins flowing through the triac 102. When the current through the triac 102 falls to zero, the capacitor 10S connected to the resistor 100 delays the firing of the diac 101 as a function $\phi=\omega RC$. A conduction angle is realized. In the next half cycle, the capacitor 105 again passes the A.C. power signal to the diac firing voltage, causing the diac 101 to trigger the triac 102 into the conduction state. When the current through the triac 102 falls to zero, the capacitor 105 connected to the resistor 100 delays the firing of the triac 102 as a function of $\phi=\omega RC$. A fixed conduction phase angle $\theta$ is formed from the firing point to the end of the A.C. line voltage such that the triac 102 will conduct in the conduction phase angle region for each subsequent half cycle. Finally, the radio frequency voltage conducted back to the A.C. line is reduced by the low pass filter formed from the capacitor 108, inductor 109, and capacitor 110.

Figure 2:
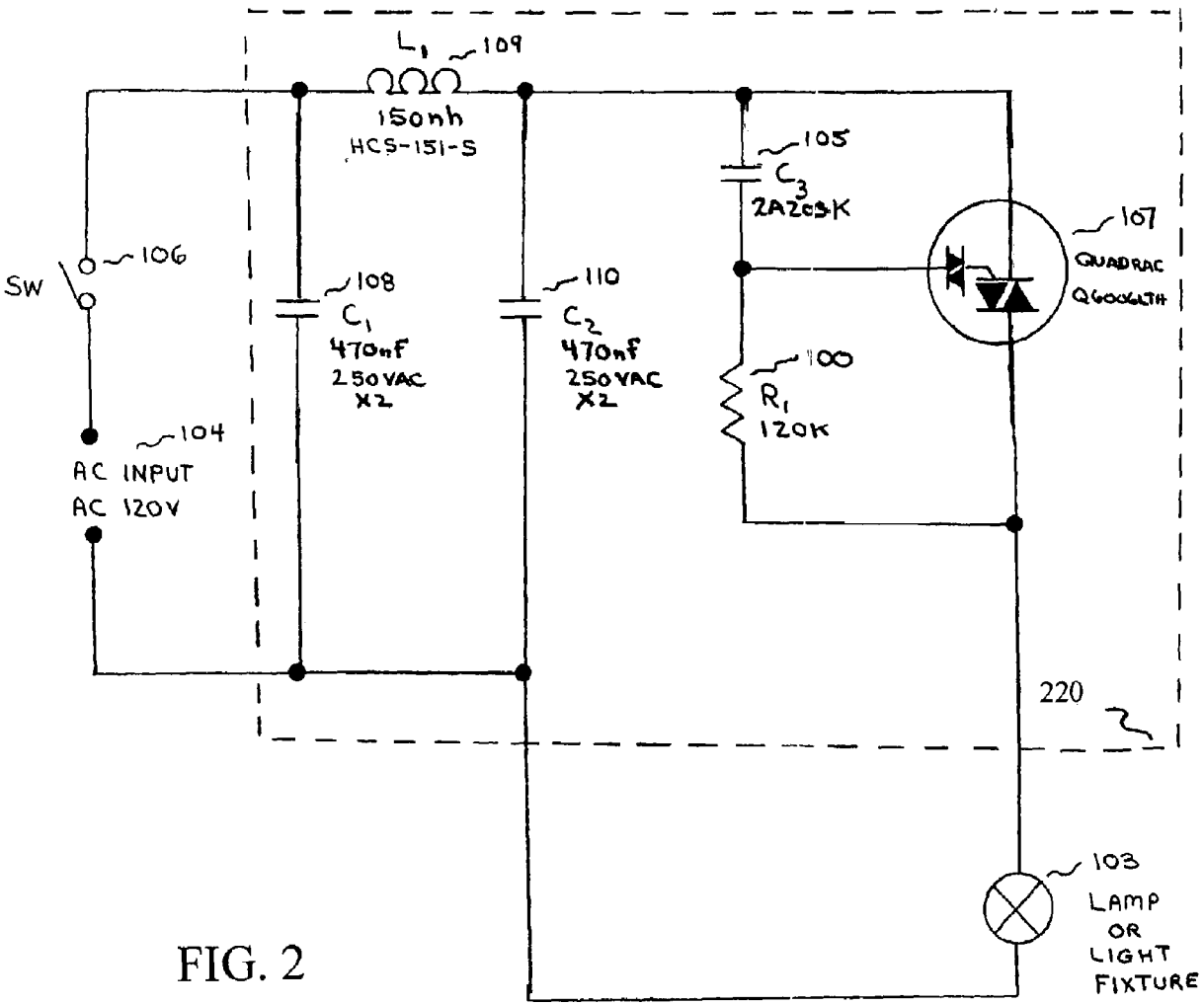
FIG. 2 illustrates a schematic diagram of a fixed phase control circuit 220 according to an alternate embodiment of the present invention.

FIG. 2 illustrates a schematic diagram of a fixed phase control circuit 220 according to an alternate embodiment of the present invention. In FIG. 2 the diac 101 and triac 102 of FIG. 1A are incorporated in a single device called a quadrac 107. A quadrac is an electrical device that includes a diac and a triac in the same package. The schematic diagram as illustrated in FIG. 2 is otherwise functionally identical to that of FIG. 1A. A suitable quadrac 107 is part number Q6006LTH obtainable from All American Semiconductor located at 8310 Guilford Road, Suite A, Columbia, Md. 21046. Given the electrical connections in FIG. 2, the operation of the fixed phase control circuit 220 in conjunction with the lamp or light fixture is functionally identical to that of FIG. 1A, with quadrac performing both functions of diac 101 and triac 102 as in FIG. 1A. The A.C. input 104 is likewise preferably supplying 120 V.A.C. to the fixed phase control circuit 220.

Figure 3A:
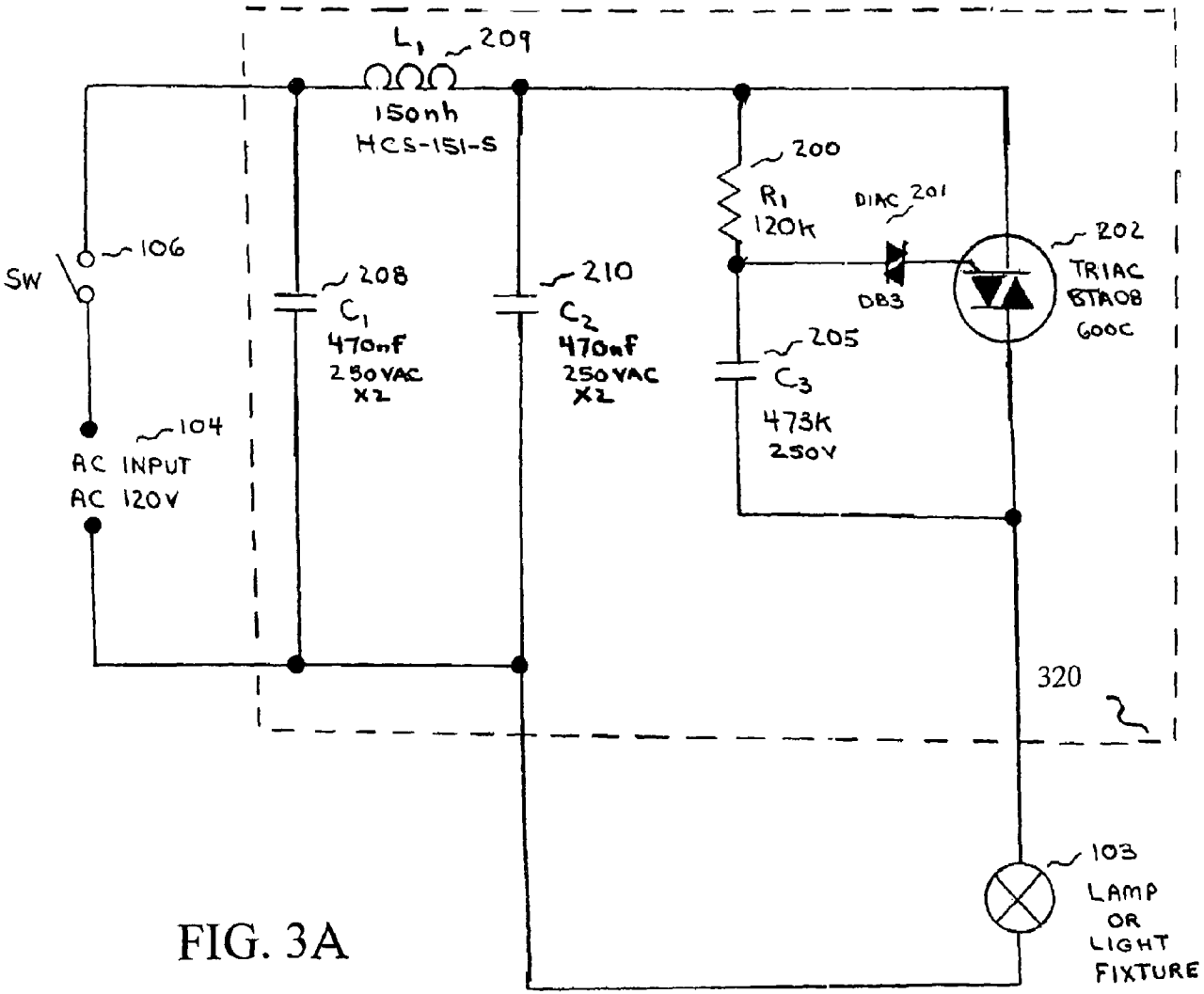
FIG. 3A illustrates a schematic diagram of a fixed phase control circuit 320 according to yet another embodiment of the present invention.

FIG. 3A illustrates a schematic diagram of a fixed phase control circuit 320 according to yet another embodiment of the present invention. The fixed phase control circuit 320 of FIG. 3A is identical to that of FIG. 1A except that the position of resistor 200 and capacitor 205 is reversed. The value of capacitor 205 is also different, approximately 0.047 uf, and may be part number TS01002E473KSB000 obtainable from Suntan located at Unit A–B, 12F, Everest Industrial Centre, 396 Kwun Tong Road, Kwun tong, Kowloon, Hong Kong.

Figure 3B:
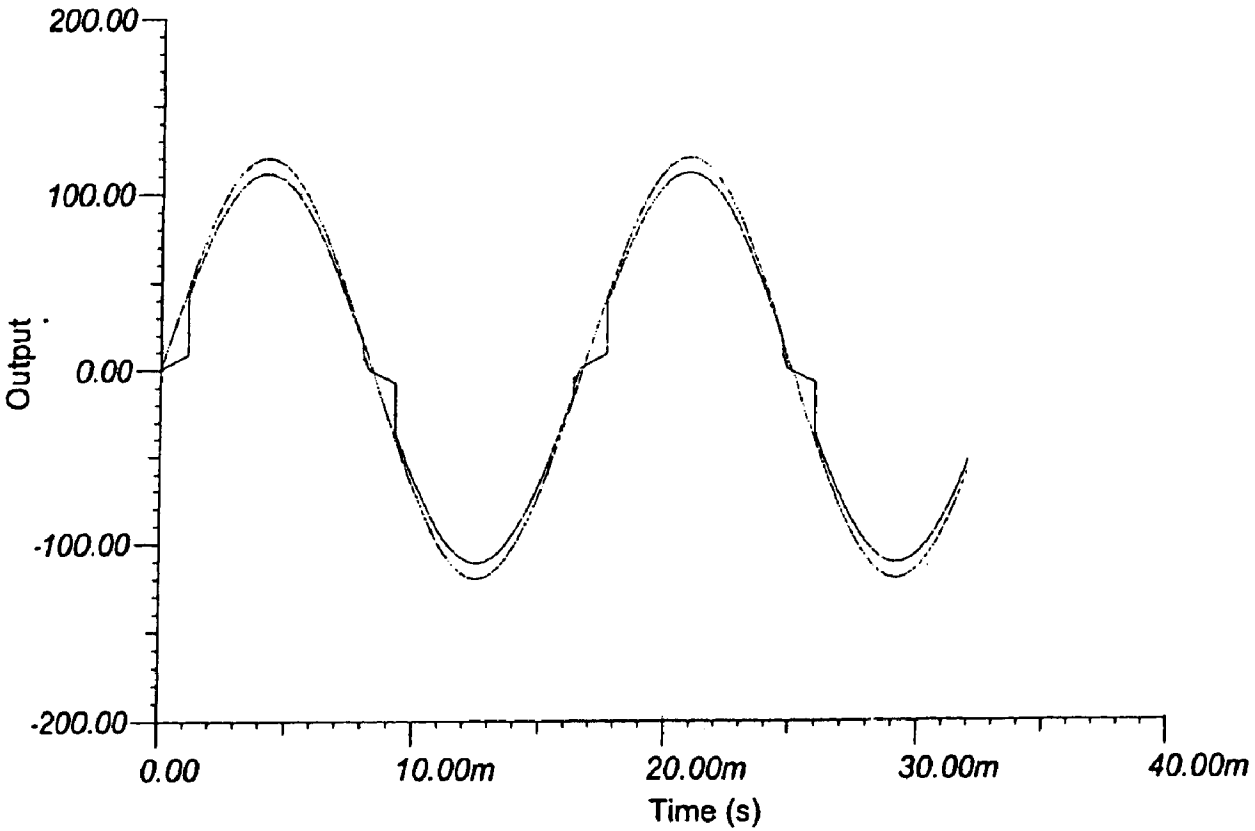
FIG. 3B is a composite graph of a 60 Hz A.C. power signal provided by the A.C. input 104 and the fixed phase control A.C. power signal presented to the lamp or light fixture 103, depicting the delay phase angle and conduction angle of the A.C. power line as a function of angular degrees, using the fixed phase control circuit 320 of FIG. 3A.

The operation is similar to the embodiment of FIG. 1A: when the A.C. power is applied, capacitor 208, inductor 209, and capacitor 210 reduce the radio frequency voltage conducted back onto the A.C. power line. The resistor 200 and capacitor 205 form a lag phase shift circuit with respect to the input 120 A.C. power signal. Then the A.C. power, applied to resistor 200, charges capacitor 205 and delays the firing point of the diac 201 at above and below the zero crossing point. When the capacitor 205 charges to the firing point of the diac 201, the capacitor 205 discharges through the diac 201. Triac 202 is triggered into a conduction mode whereby A.C. power signal begins flowing through triac 202. At the instance the firing voltage is reached and the diac 201 fires, the capacitor 205 discharges. The capacitor does not completely discharge and has a residual voltage remaining. A conduction phase angle $\theta$ is realized. In the next half cycle, the capacitor 205 again charges to the diac firing voltage causing the diac 201 to trigger the triac 202 into the conduction state. A fixed conduction phase angle $\theta$ is formed from the firing point to the end of a half cycle of the A.C. line voltage such that the triac 202 will conduct in the conduction phase angle region for each subsequent half cycle. Finally, the radio frequency voltage conducted back to the A.C. line is reduced by the low pass filter formed from capacitor 208, inductor 209, and capacitor 210. The A.C. power signal supplied to the lamp or light fixture 103 is the fixed phase control A.C. power signal as illustrated in FIG. 3B. The simulated drawing depicts the delay phase angle and conduction angle of the A.C. power line as a function of angular degrees.

As described previously in regard to FIG. 1A, the diac 201 and the triac 202 of FIG. 3A may likewise be combined in a single quadrac, a preferred quadrac being part number Q6006LTH obtainable from All American Semiconductor, supra.

Figure 4:
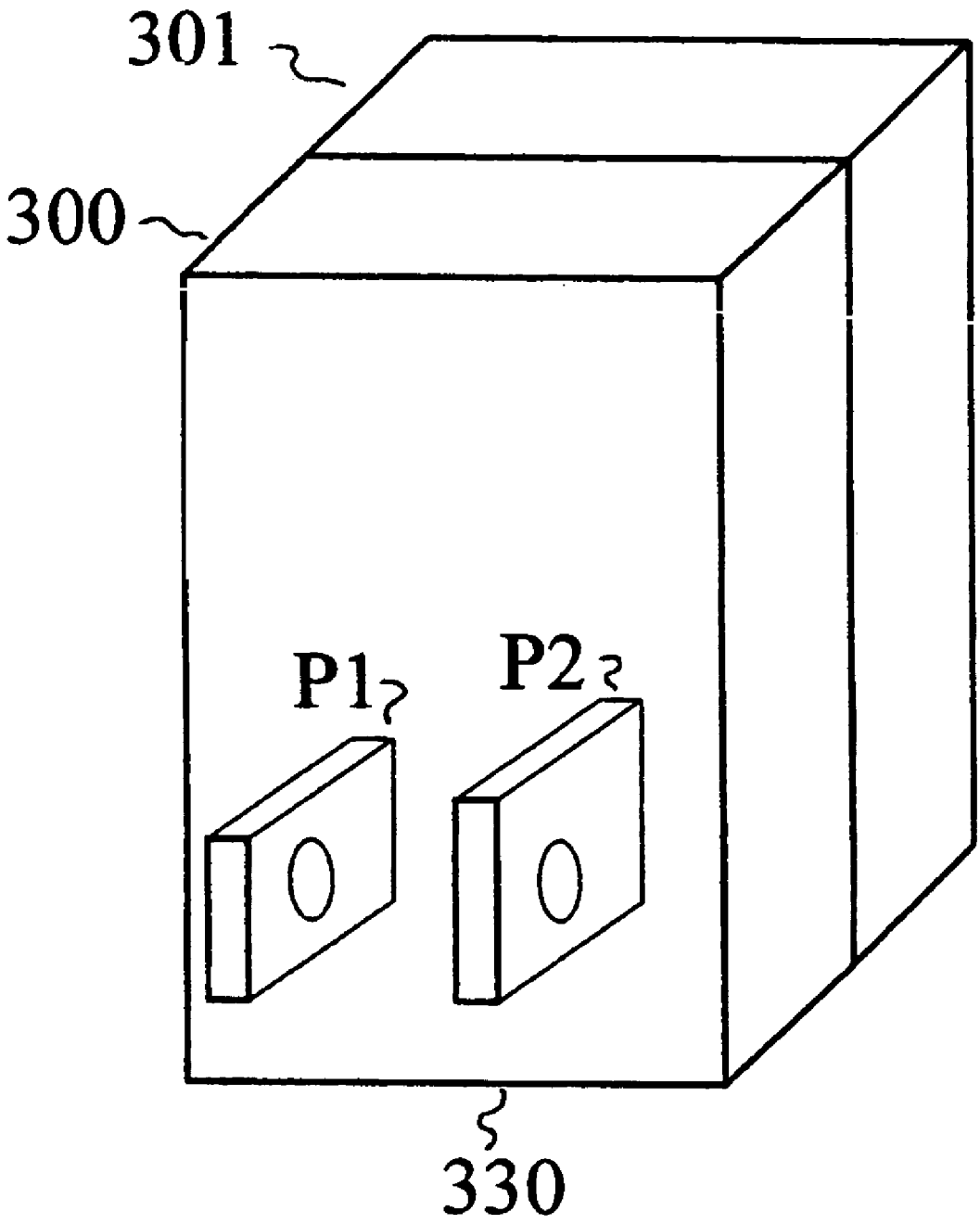
FIG. 4 illustrates a front view of a "plug-in/plug-into" enclosure for use with the circuits of FIGS. 1–3.

FIG. 4 illustrates a "plug-in/plug-into" enclosure for use with the circuits of FIGS. 1A, 2 and 3A.

Figure 5:
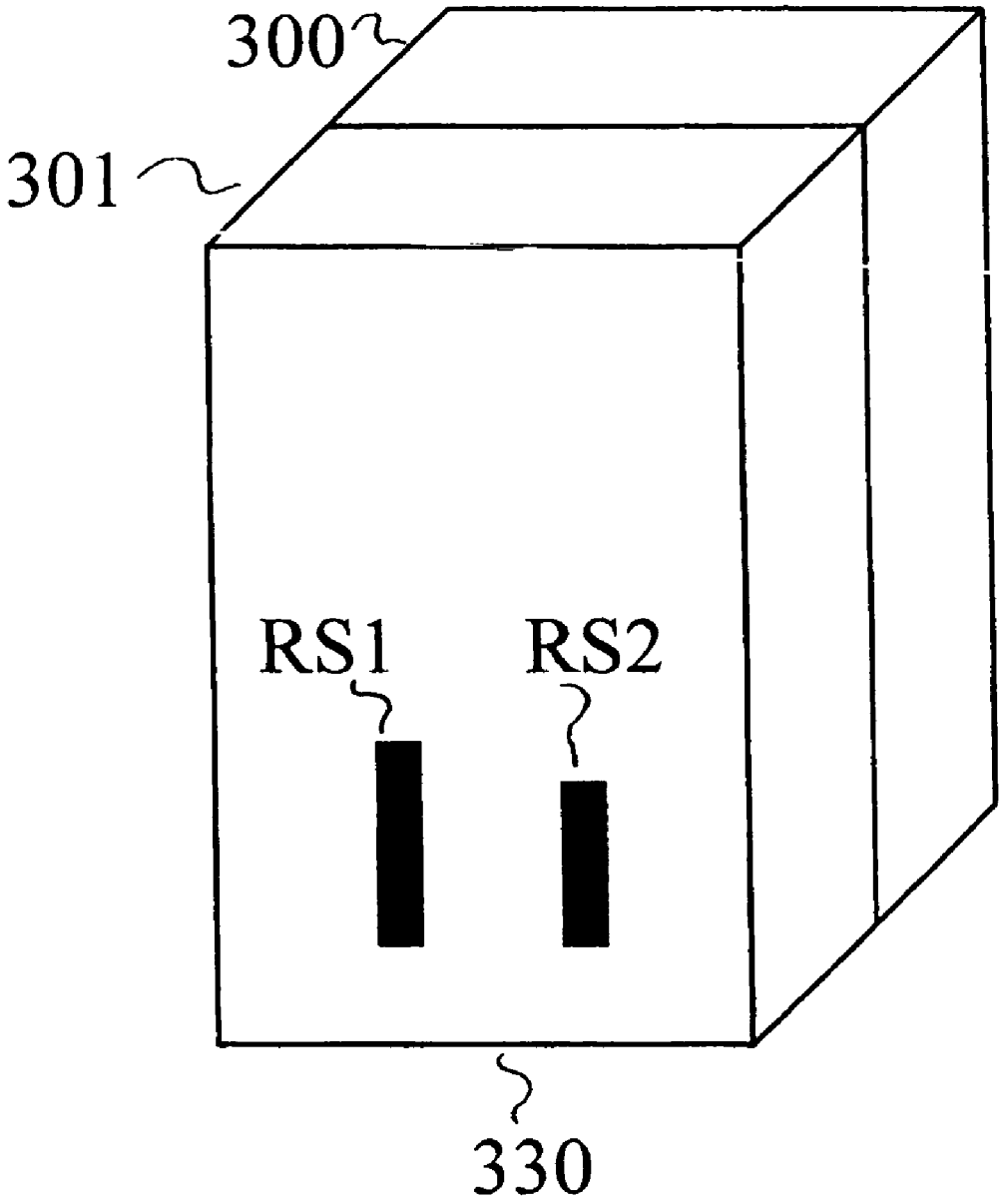
FIG. 5 illustrates a rear view of the "plug-in/plug-into" enclosure of FIG. 4.

In FIG. 4, the enclosure 330 comprises two parts 300 and 301 that are snapped or bonded together with two power input prongs P1 and P2 emergent from part 300. The input prongs P1 and P2 are rigidly mounted inside part 300. These power input prongs P1 and P2 connect or plug into an ordinary 120 V.A.C. 60 Hz power line. As shown in FIG. 5, two receptacle slots RS1 and RS2 are located on part 301. A standard power cord from a lamp or light fixture 103 plugs into slots RS1 and RS2 of the plug in/plug into enclosure.

Figure 6:
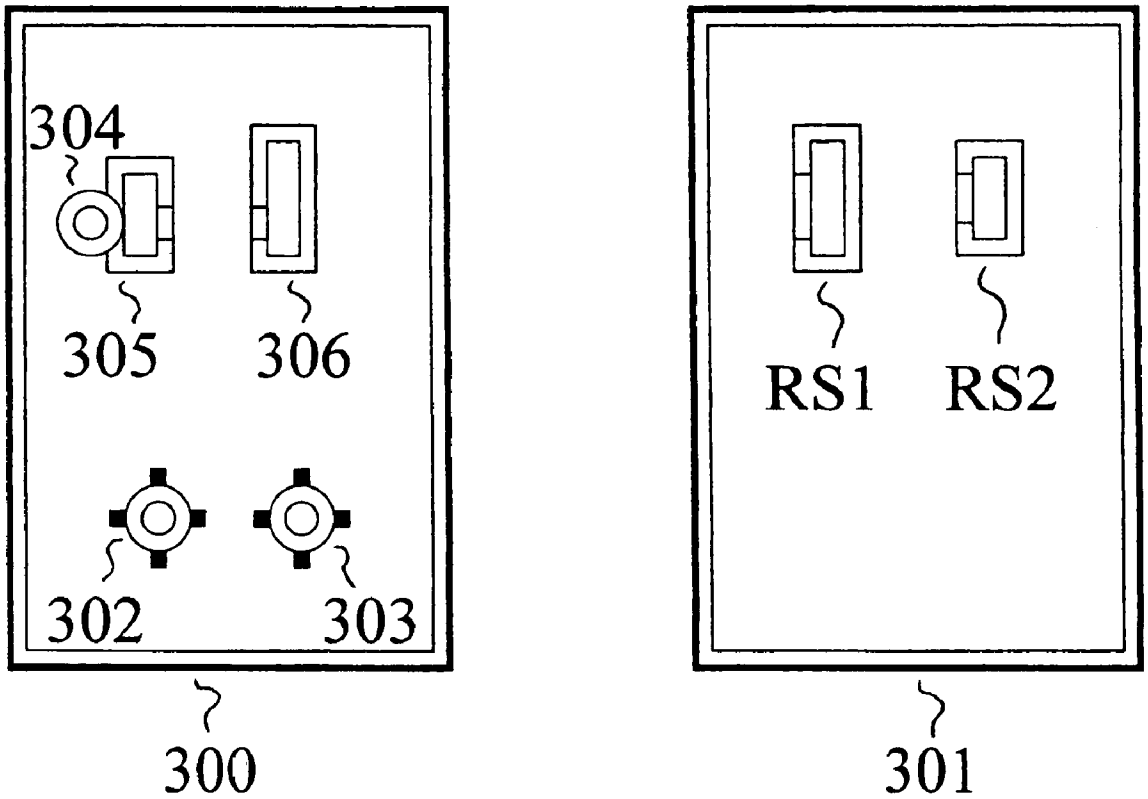
FIG. 6 shows an internal view of the two parts 300 and 301 of FIGS. 4 and 5 side-by-side.

FIG. 6 shows an internal view of the two parts 300 and 301 of FIGS. 4 and 5 side-by-side. Part 300 has two tapered projecting posts 302 and 303 onto which the circuit board 120, 220 or 320 slides with pinhole 304 to securely mount circuit board 120, 220 or 320. Slots 305 and 306 securely hold power input prongs P1 and P2 illustrated in FIG. 4. Part 301 contains the projecting slots RS1 and RS2 into which the standard power cord from a lamp or light fixture 103 plugs. The two parts 300 and 301 are secured together to enclose the circuit board containing the fixed phase control circuit 120, 220 or 320 as described above.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

What is claimed is:

1. An incandescent light bulb life extending apparatus, comprising:

a fixed phase control circuit for connection between standard 120V AC power source and an existing incandescent lighting circuit, said fixed phase control circuit including a low pass filter comprising a two capacitors coupled in said 120V AC power source and an inductor coupled in series between said two capacitors, a triac coupled to said lighting circuit, a diac coupled between said low pass filter and triac for gating said triac, and a phase shift lead circuit connected between said 120V AC power source and said diac for gating said diac, said fixed phase control circuit operating to wave shape the A.C. power from said source as applied to said lighting circuit at a specific phase that does not change.

2. The incandescent light bulb life extending apparatus according to claim 1, wherein said low pass filter further comprises two capacitors coupled together through an inductor.

3. An incandescent light bulb life extending apparatus, comprising:

a fixed phase control circuit for connection between standard 120V AC power source and an existing incandescent lighting circuit, said fixed phase control circuit including a low pass filter comprising a two capacitors coupled in said 120V AC power source and an inductor coupled in series between said two capacitors, a triac coupled to said lighting circuit, and a diac coupled between said low pass filter and triac for gating said triac, said fixed phase control circuit operating to wave shape the A.C. power from said source as applied to said lighting circuit at a specific phase that does not change; and an enclosure having prongs on one side for plugging into said standard 120V AC power source, and a receptacle on another side for plugging in of said incandescent lighting circuit power cord.

4. An incandescent light bulb life extending apparatus, comprising:

a fixed phase control circuit for connection between standard 120V AC power source and an existing incandescent lighting circuit, said fixed phase control circuit including a low pass filter comprising a two capacitors coupled in parallel to said 120V AC power source and an inductor coupled in series between said capacitor and said existing incandescent lighting circuit, said fixed phase control circuit further comprising a quadrac having junction leads coupled to said lighting circuit and a gate, and a phase shift lead circuit connected between said 120V AC power source and the gate of said guadrac for gating said quadrac, said fixed phase control circuit operating to wave shape the A.C. power from said source as applied to said lighting circuit at a specific phase that does not change.

5. The incandescent light bulb life extending apparatus according to claim 4, wherein said low pass filter further comprises two capacitors coupled together through an inductor.

6. An incandescent light bulb life extending apparatus, comprising:

a fixed phase control circuit for connection between standard 120V AC power source and an existing incandescent lighting circuit, said fixed phase control circuit including a low pass filter comprising a two capacitors coupled in said 120V AC power source and an inductor coupled in series between said two capacitors, a quadrac having junction leads coupled to said lighting circuit and a gate coupled to said low pass filter for gating said quadrac, said fixed phase control circuit operating to wave shape the A.C. power from said source as applied to said lighting circuit at a specific phase that does not change; and an enclosure having prongs on one side for plugging into said standard 120V AC power source, and a receptacle on another side for plugging in of said incandescent lighting circuit power cord.

7. A life extending incandescent light bulb apparatus fixed phase control circuit, comprising:

first and second connection terminals for connection to an AC power source;

third and fourth terminals for connection to an existing incandescent light fixture;

a first capacitor parallel-connected across said first and second terminals;

an inductor connected on one side to said first terminal;

a second capacitor connected from another side of said inductor to said second terminal;

a third capacitor connected in series with a resistor from another side of said inductor to said second terminal;

a diac connected on one side between the third capacitor and resistor;

a triac connected from another side of said inductor to said second terminal, and said triac having a gate connected to another side of said diac.

8. The incandescent light bulb life extending apparatus according to claim 7, further comprising an enclosure having prongs on one side for plugging into said standard 120V AC power source, and a receptacle on another side for plugging in of said incandescent lighting circuit power cord.

9. A life extending incandescent light bulb apparatus fixed phase control circuit, comprising:

first and second connection terminals for connection to an AC power source;

third and fourth terminals for connection to an existing incandescent light fixture;

a first capacitor parallel-connected across said first and second terminals;

an inductor connected on one side to said first terminal;

a second capacitor connected from another side of said inductor to said second terminal;

a third capacitor connected in series with a resistor from another side of said inductor to said second terminal;

a quadrac connected from another side of said inductor to said second terminal, and said quadrac having a gate connected between said third capacitor and resistor.

10. The incandescent light bulb life extending apparatus according to claim 9, further comprising an enclosure having prongs on one side for plugging into said standard 120V AC power source, and a receptacle on another side for plugging in of said incandescent lighting circuit power cord.

11. An incandescent light bulb life extending apparatus, comprising:

a fixed phase control circuit for connection between standard 120V AC power source and an existing incandescent lighting circuit, said fixed phase control circuit including a low pass filter comprising a two capacitors coupled in parallel to said 120V AC power source and an inductor coupled in series between said capacitor and said existing incandescent lighting circuit, said fixed phase control circuit further comprising atriac coupled to said lighting circuit, a diac coupled between said low pass filter and triac for gating said triac, and a phase shift lead circuit connected between said 120V AC power source and the gate of said diac, said fixed phase control circuit operating to wave shape the A.C. power from said source as applied to said lighting circuit at a specific phase that does not change.

* * * * *